US008057076B2

(12) United States Patent
Lu et al.

(10) Patent No.: US 8,057,076 B2
(45) Date of Patent: Nov. 15, 2011

(54) LED LAMP HAVING A CASING FIXED TO A FIXING ROD AND A HEAT DISSIPATING MEMBER FIXED TO THE CASING

(75) Inventors: Zhong-Liang Lu, Shenzhen (CN); Yong-Dong Chen, Shenzhen (CN); Shih-Hsun Wung, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 348 days.

(21) Appl. No.: 12/430,855

(22) Filed: Apr. 27, 2009

(65) Prior Publication Data

US 2010/0165626 A1 Jul. 1, 2010

(30) Foreign Application Priority Data

Dec. 31, 2008 (CN) ..... 2008 1 0306749

(51) Int. Cl.
*F21V 29/00* (2006.01)
*F21V 21/116* (2006.01)
*F21S 4/00* (2006.01)

(52) U.S. Cl. ..... 362/373; 362/249.02; 362/431

(58) Field of Classification Search ..... 362/249.02, 362/249.06, 373, 294, 431
See application file for complete search history.

(56) References Cited

U.S. PATENT DOCUMENTS

| | | | | |
|---|---|---|---|---|
| 6,908,214 | B2 * | 6/2005 | Luk | 362/249.02 |
| 7,708,452 | B2 * | 5/2010 | Maxik et al. | 362/249.02 |
| 2007/0279862 | A1 * | 12/2007 | Li | 361/692 |
| 2009/0040759 | A1 * | 2/2009 | Zhang et al. | 362/249 |

* cited by examiner

*Primary Examiner* — Alan Cariaso
(74) *Attorney, Agent, or Firm* — Altis Law Group, Inc.

(57) ABSTRACT

An LED lamp fixed to an end of a fixing rod, includes a casing, a heat dissipating member fixed to a bottom of the casing and a plurality of LED modules attached to a bottom of the heat dissipating member. The casing has a sleeve part and a mounting part integrally extending from an end of the sleeve part. A plurality of connecting plates extend inwardly along radial directions from an inner wall of the sleeve part. The fixing rod is inserted into the sleeve part of the casing and secured within free, inner ends of the connecting plates.

16 Claims, 5 Drawing Sheets

LED LAMP HAVING A CASING FIXED TO A FIXING ROD AND A HEAT DISSIPATING MEMBER FIXED TO THE CASING

BACKGROUND

1. Technical Field

The disclosure relates to an LED lamp for lighting, and more particularly to an LED lamp having a casing connecting with a fixing rod, in which the casing is in thermal connection with LED modules of the LED lamp.

2. Description of Related Art

An LED lamp is a type of solid-state lighting that utilizes light-emitting diodes (LEDs) as a source of illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

A conventional LED lamp is mounted to an upper, front end of a fixing rod by securing the upper, front end of the fixing rod in a casing of the LED lamp. The connection between the casing and the fixing rod is complicated and unreliable. Furthermore, the casing is formed by metal die casting, which has a high manufacturing cost. Finally, the casing does not function to help dissipating heat of the LEDs of the LED lamp, which results in that heat generated by the LEDs can not be effectively dissipated.

What is needed, therefore, is an improved LED lamp which can overcome the described limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
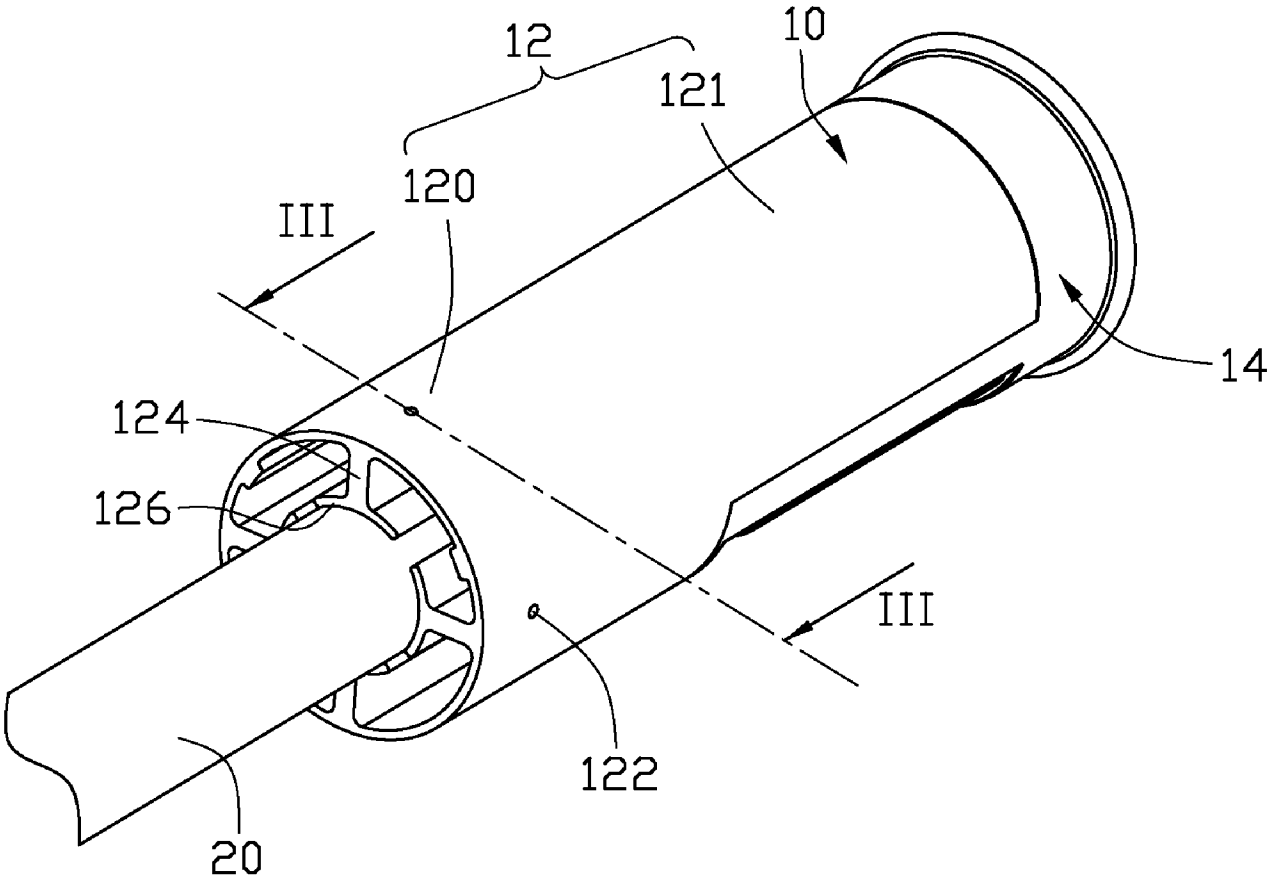
FIG. 1 is an isometric, assembled view of an LED lamp in accordance with an embodiment of the present invention.
Figure 2:
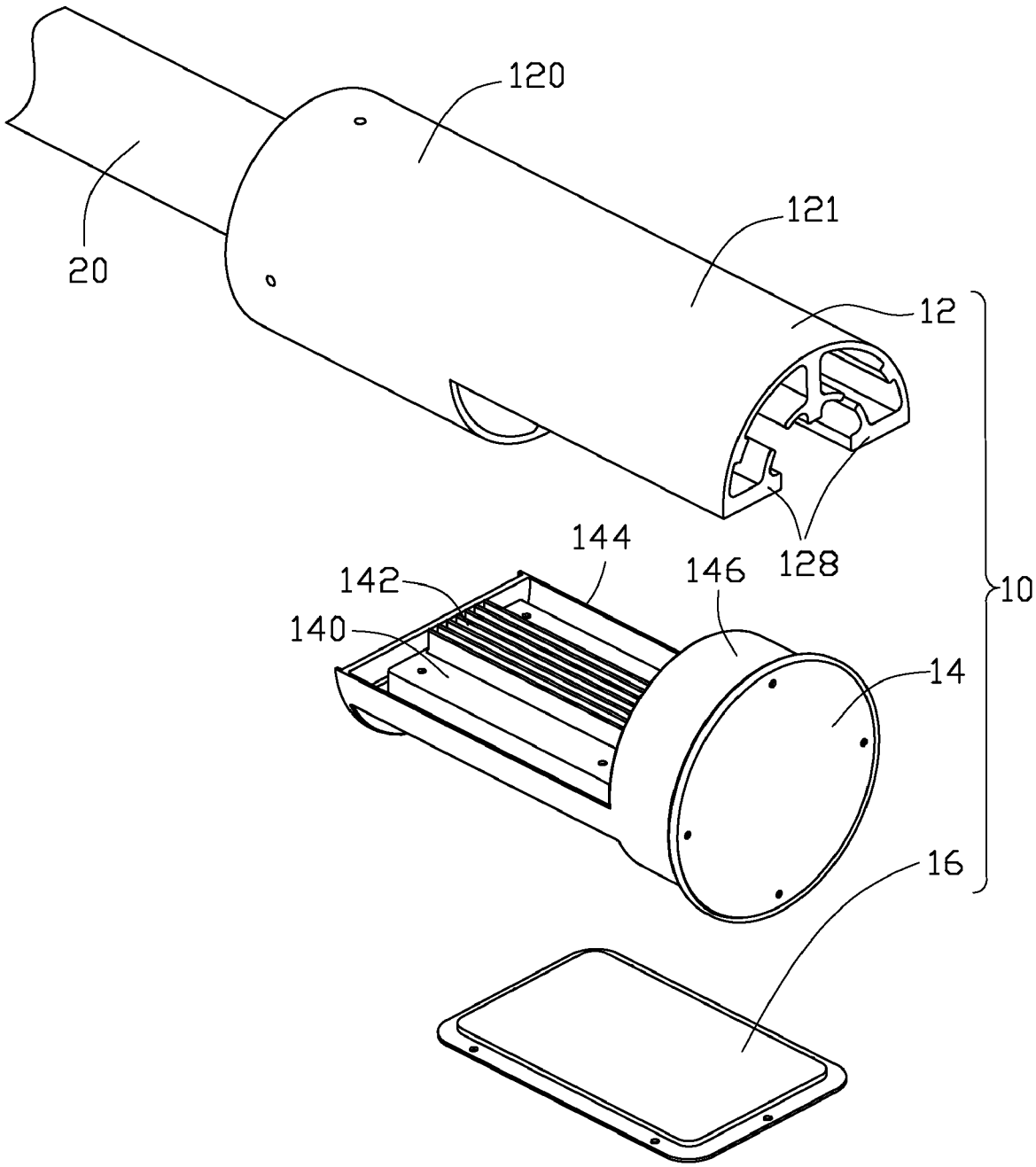
FIG. 2 is an exploded view of the LED lamp of FIG. 1.
Figure 3:
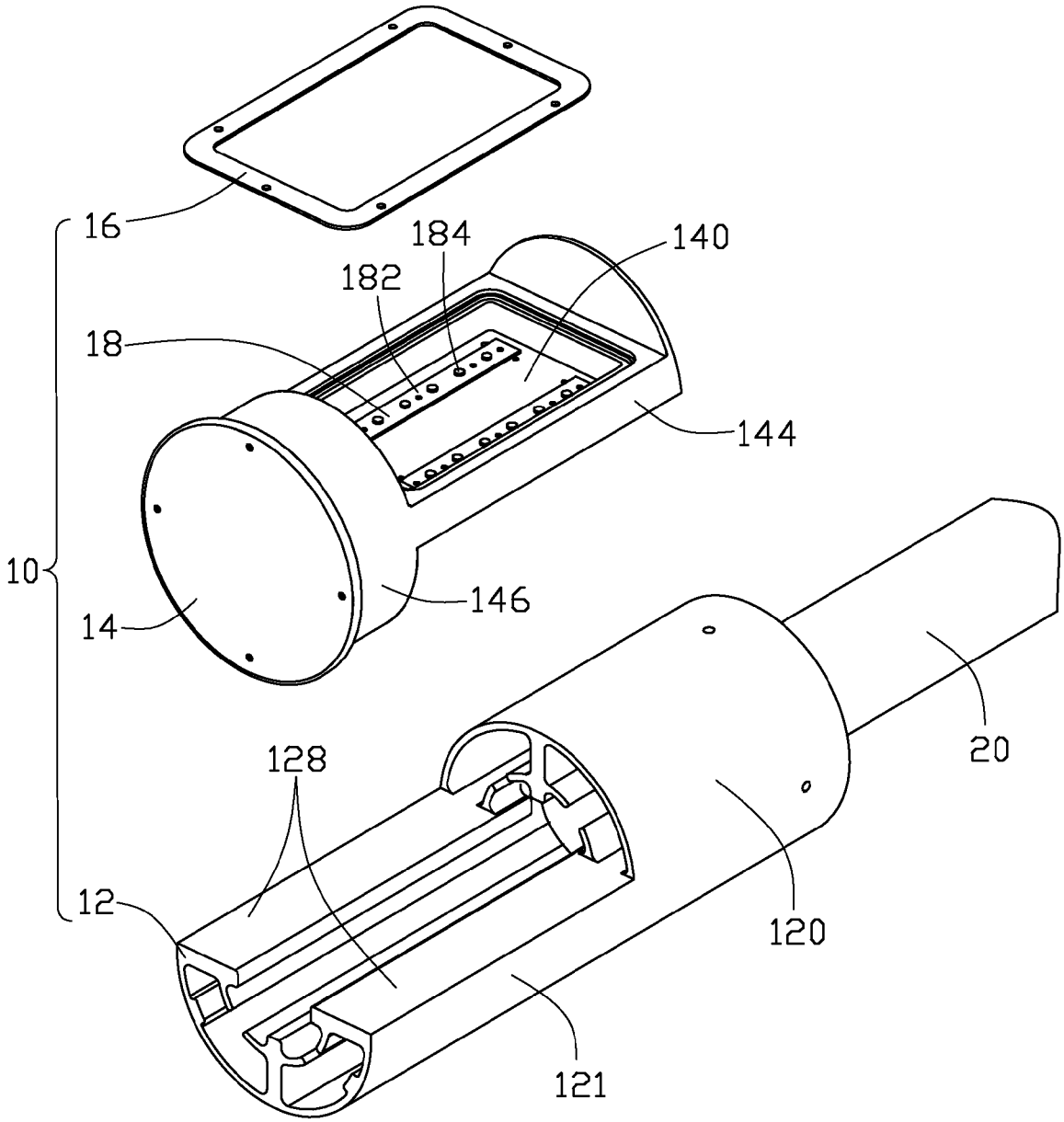
FIG. 3 is an inverted view of the LED lamp of FIG. 2.
Figure 4:
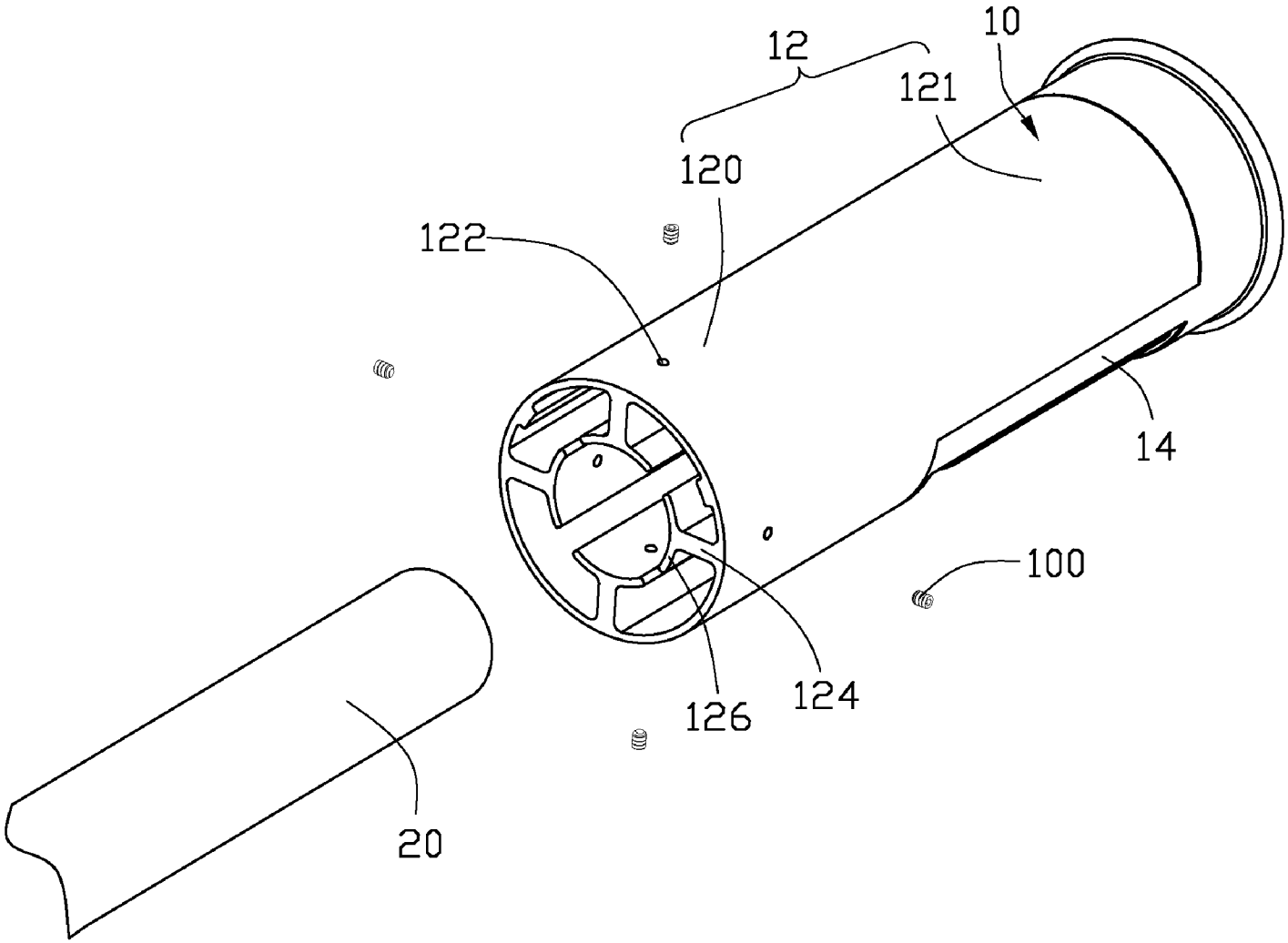
FIG. 4 is an isometric, assembled view of the LED lamp of FIG. 1, in which a fixing rod and screws of the LED lamp are separated therefrom.
Figure 5:
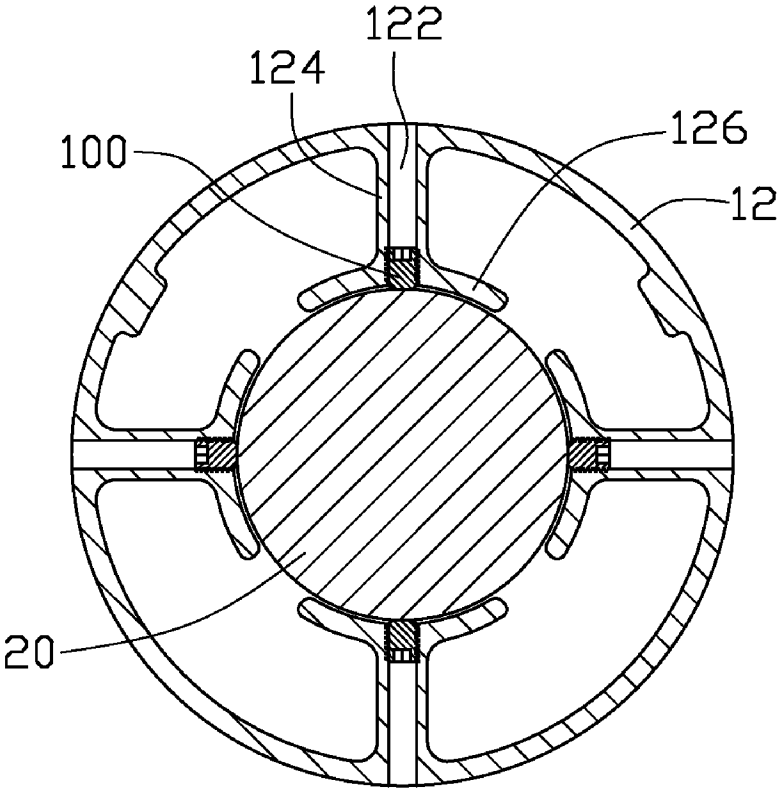
FIG. 5 is a cross section view taken along line III-III in FIG. 1.

Referring to FIGS. 1-3, an LED lamp 10 in accordance with an embodiment is illustrated. A rear portion of the LED lamp 10 is fixed to a front end of a fixing rod 20. The LED lamp 10 comprises a casing 12, a heat dissipating member 14 coupled to a bottom and a front end of a front portion of the casing 12, a plurality of LED modules 18 attached to a bottom of the heat dissipating member 14 and a lens 16 engaging with the bottom of the heat dissipating member 14 to enclose the LED modules 18 therein.

The casing 12 is tubular and column-shaped, though it may have other configurations in alternative embodiments. The casing 12 is integrally formed by aluminum extrusion molding. The casing 12 has two parts performing different functions: a sleeve part 120 and a mounting part 121 integrally extending outwardly from a front end of the sleeve part 120. The sleeve part 120 has four connecting plates 124 extending inwardly from an inner wall of the casing along equidistantly radial directions and four retaining plates 126 formed at distal ends (i.e., free and inner ends) of the connecting plates 124. The connecting plates 124 are symmetrical relative to an axis of the sleeve part 120. Every two neighboring connecting plates 124 are perpendicular to each other. Each retaining plate 126 is arc-shaped and symmetrical relative to the corresponding connecting plate 124. The four retaining plates 126 cooperate with each other to form a retaining sleeve in the sleeve part 120, for engagingly receiving the front end of the fixing rod 20. Four threaded holes 122 are defined in a cylindrical surface of the sleeve part 120 and extend through the connecting plates 124 and the corresponding retaining plates 126 along the radial directions. Four screws 100 screw into the four threaded holes 122, until their front ends project from the four threaded holes 12 to press at a cylindrical surface of the fixing rod 20 to thus securely lock the fixing rod 20 in the sleeve part 120 of the casing 12.

The mounting part 121 is semi-cylindrical and has two mounting plates 128 extending inwardly and horizontally from two lower edges thereof. The two mounting plates 128 are connected and coplanar with two corresponding connecting plates 124 of the sleeve part 120, and extend integrally and forwardly from front ends of the two corresponding connecting plates 124.

The heat dissipating member 14 is integrally formed from a material with a high heat conductivity such as aluminum or copper and comprises a rectangular base plate 140 attached to a bottom surface of the mounting plates 128 of the mounting part 121 of the casing 12, a plurality of fins 142 extending upwardly from a top surface of the base plate 140, a frame 144 extending downwardly from an edge of the base plate 140 and a circular end cap 146 formed at a front end of the frame 144. The fins 142 received in the mounting part 121 of the casing 12 are perpendicular to the base plate 140 and located between the two mounting plates 128 of the mounting part 121. The end cap 146 is perpendicular to the base plate 140 and engages with a front end of the casing 12.

The LED modules 18 are parallel to each other and evenly attached to a bottom surface of the base plate 140. Each LED module 18 comprises an elongated circuit board 182 and a plurality of LEDs 184 arranged on the circuit board 22 along a length of the circuit board 182.

The lens 16 is rectangular and engages a lower edge of the frame 144 of the heat dissipating member 14 to enclose the LED modules 18.

In the present disclosure, the casing 12 is made by aluminum extrusion molding, which can have a low manufacturing cost. Further, the casing 12 is in heat conductive relation with the LED modules 18, whereby heat generated by the LEDs 184 can be effectively dissipated.

In use, heat generated by the LED modules 18 is absorbed by the base plate 140 of the heat dissipating member 14 and then distributed over the fins 142 of the heat dissipating member 14 to dissipate into air inside the casing 12. Additionally, heat accumulated in the heat dissipating member 14 is simultaneously conducted to the casing 12 via the mounting plate 128 of the mounting part 121 of the casing 12 to dissipate directly into ambient environment.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED (light emitting diode) lamp fixed to an end of a fixing rod, comprising:

a casing comprising a sleeve part and a mounting part integrally extending from an end of the sleeve part, a plurality of connecting plates extending inwardly along radial directions from an inner wall of the sleeve part;

a heat dissipating member fixed to a bottom of the mounting part of the casing; and a plurality of LED modules attached to a bottom of the heat dissipating member;

wherein the fixing rod is inserted into the sleeve part of the casing, surrounded by distal ends of the connecting plates and secured to the distal ends of the connecting plates; and wherein the heat dissipating member comprises a base plate fixed to a bottom of the mounting part of the casing and a plurality of fins extending upwardly from the base plate into the mounting part of the casing, the LED modules being attached to a bottom surface of the base plate.

2. The LED lamp as claimed in claim 1, wherein the casing is integrally formed from a material with a high heat conductivity and connected to the LED modules in a thermally conductive relationship.

3. The LED lamp as claimed in claim 1, wherein a plurality of retaining plates are respectively formed at the distal ends of the connecting plates and surround the fixing rod.

4. The LED lamp as claimed in claim 3, wherein every two neighboring connecting plates are perpendicular to each other, the retaining plates cooperating with each other to form a retaining sleeve receiving the fixing rod therein.

5. The LED lamp as claimed in claim 4, wherein four threaded holes are defined in a cylindrical surface of the sleeve part of the casing and extend through the connecting plates and the retaining plates along the radial directions, four screws being screwed through the four threaded holes to press at a cylindrical surface of the fixing rod to thus lock the fixing rod in the sleeve part of the casing.

6. The LED lamp as claimed in claim 1, wherein two coplanar and spaced mounting plates extend inwardly from lower edges of the mounting part of the casing and contact with the base plate of the heat dissipating member, the fins being located between the mounting plates.

7. The LED lamp as claimed in claim 6, wherein the mounting part of the casing is semi-cylindrical, the mounting plates integrally extending forwardly from front ends of two coplanar connecting plates of the sleeve part of the casing, the fixing rod being securing to a rear end of the casing.

8. The LED lamp as claimed in claim 1, wherein the heat dissipating member further comprises a frame extending downwardly from an edge of the base plate and an end cap formed at an end of the frame and engaging with an end of the mounting part of the casing.

9. The LED lamp as claimed in claim 8, further comprising a lens engaging with a lower edge of the frame to enclose the LED modules.

10. An LED lamp fixed to an end of a fixing rod, comprising:

a tubular casing having a plurality of connecting plates extending inwardly along radial directions from an inner wall of the casing; and a plurality of LED modules connected to the casing in a thermally conductive relationship;

wherein the casing receives the fixing rod therein and securing the fixing rod within distal ends of the connecting plates;

wherein a plurality of retaining plates are respectively formed at the distal ends of the connecting plates and surround the fixing rod; and wherein a plurality of threaded holes are defined in a cylindrical surface of the casing and extend through the connecting plates and the retaining plates along the radial directions, a plurality of screws being screwed through the plurality of threaded holes to press at a cylindrical surface of the fixing rod to thus lock the fixing rod in the casing.

11. The LED lamp as claimed in claim 10, wherein the casing is integrally formed from a material with a high heat conductivity.

12. The LED lamp as claimed in claim 10, wherein the casing comprises a sleeve part at a rear portion thereof and a semi-cylindrical mounting part integrally extending from a front end of the sleeve part, the fixing rod being fixed in the sleeve part, the LED module being fixed below a bottom of the mounting part.

13. The LED lamp as claimed in claim 12, further comprising a heat dissipating member, wherein the heat dissipating member comprises a base plate fixed to a bottom of the mounting part of the casing and a plurality of fins extending upwardly from the base plate into the mounting part of the casing, the LED modules being attached to a bottom surface of the base plate.

14. The LED lamp as claimed in claim 13, wherein two coplanar and spaced mounting plates extend inwardly from lower edges of the mounting part of the casing and contact with the base plate of the heat dissipating member, the fins located between the mounting plates.

15. The LED lamp as claimed in claim 10, wherein the tubular casing is formed by aluminum extrusion molding.

16. An LED lamp fixed to an end of a fixing rod, comprising:

a casing comprising a sleeve part and a mounting part integrally extending from an end of the sleeve part, a plurality of connecting plates extending inwardly along radial directions from an inner wall of the sleeve part;

a heat dissipating member fixed to a bottom of the mounting part of the casing; and a plurality of LED modules attached to a bottom of the heat dissipating member;

wherein the fixing rod is inserted into the sleeve part of the casing, surrounded by distal ends of the connecting plates and secured to the distal ends of the connecting plates;

wherein a plurality of retaining plates are respectively formed at the distal ends of the connecting plates and surround the fixing rod;

wherein every two neighboring connecting plates are perpendicular to each other, the retaining plates cooperating with each other to form a retaining sleeve receiving the fixing rod therein; and wherein four threaded holes are defined in a cylindrical surface of the sleeve part of the casing and extend through the connecting plates and the retaining plates along the radial directions, four screws being screwed through the four threaded holes to press at a cylindrical surface of the fixing rod to thus lock the fixing rod in the sleeve part of the casing.

* * * * *